US006354820B1

(12) United States Patent
Iijima

(10) Patent No.: US 6,354,820 B1
(45) Date of Patent: Mar. 12, 2002

(54) PUMP

(76) Inventor: Jun Iijima, 18-14-219, Tamagawandai 2-chome, Setagaya-ku, Tokyo 158-0096 (JP)

( * ) Notice: Subject to any disclaimer, the term of this patent is extended or adjusted under 35 U.S.C. 154(b) by 0 days.

(21) Appl. No.: 09/618,642

(22) Filed: Jul. 18, 2000

(30) Foreign Application Priority Data

Nov. 9, 1999 (JP) ..... 11-318166

(51) Int. Cl.[7] ..... F04B 39/10

(52) U.S. Cl. ..... 417/490; 417/481; 417/489; 417/498; 92/177; 92/240; 92/249

(58) Field of Search ..... 417/484, 481, 417/489, 490; 92/177, 249, 240

(56) References Cited

U.S. PATENT DOCUMENTS 3,523,001 A * 8/1970 Sylvester ..... 417/489
4,080,877 A * 3/1978 deFries ..... 92/61
4,540,352 A * 9/1985 Becker ..... 417/517
4,765,292 A * 8/1988 Morgado ..... 123/193 P
4,907,950 A * 3/1990 Pierrat ..... 417/271
4,979,878 A * 12/1990 Short et al. ..... 417/255
5,024,587 A * 6/1991 Maurer ..... 417/468

* cited by examiner

*Primary Examiner*—Charles G. Freay
*Assistant Examiner*—Han Lieh Liu
(74) *Attorney, Agent, or Firm*—Wenderoth, Lind & Ponack, L.L.P.

(57) ABSTRACT

For the purpose of providing a thin pump designed to decrease the number of parts, the pump is provided with a rectangular parallelepiped cylinder (3) and a piston located inside of the cylinder, wherein the piston (4) reciprocates and oscillates in the cylinder (3) to vary capacity of the pump chamber (12) and to make the intake port (5) and the outlet port (6) open alternately, so that fluid is sucked from the intake port (5) into the pump chamber (12), compressed and discharged from the outlet port (6).

18 Claims, 3 Drawing Sheets

PUMP

BACKGROUND OF THE INVENTION

This invention relates to a positive displacement pump for moving fluid.

A pump is produced for the purpose of moving fluid. The basic constitution of the positive displacement pump comprises a cylinder, a piston and a pair of check-valves (an admission valve and a delivery valve). Capacity in the cylinder is increased or decreased by reciprocating motion of the piston to vary inner pressure therein, so that the fluid is admitted via the admission valve, compressed and discharged via the delivery valve.

In such a positive displacement pump, the cylinders are normally cylindrical, and fundamentally, pistons corresponding to the cylinders are columnar. Furthermore, the check-valves are normally approximately cylindrical or columnar in their basic constitution.

Accordingly, miniaturization of the pump has to be achieved without demolishing a cylindrical or columnar basic shape, so that the miniaturization is limited. In the number of parts, the pump needs at least four such as the cylinder, the piston and the pair of check-valves as mentioned above.

SUMMARY OF THE INVENTION

It is an object of the invention to provide a pump while achieving miniaturization and a decrease in the number of parts.

A pump according to this invention is provided with a cylinder and a piston located inside of the cylinder, wherein the piston is reciprocated and oscillated in the cylinder to take fluid into the cylinder via an intake port formed on the cylinder, to compress it and to discharge it via an outlet port formed on the cylinder.

Thus, the intake port and the outlet port are closed or opened alternately by reciprocating and oscillating motion of the piston; namely, the intake port is opened and the outlet port is closed in a suction process of the piston and the intake port is closed and the outlet port is opened in a discharge process of the piston, so that the fluid can be taken in, compressed and discharged.

Moreover, a center of oscillation of the piston is maintained at a specific position in a long width direction of the cylinder and moved in a depth direction. Thus, opening and closing of the intake port and the outlet port are controlled corresponding to the suction process, the compression process and the discharge process, respectively.

A supporting point for oscillating motion of the piston can be provided by a pair of projecting portions coming in contact with the cylinder.

Reciprocating and oscillating motion of the piston is achieved by circular motion given from the outside to an outer end side of the piston.

Sealing portions for cutting off between a pump chamber and the outside of the cylinder are provided between the piston and the cylinder. The sealing portions may be formed unitedly with or separately from the piston. Thus, leakage of the fluid can be prevented by the sealing portions.

The cylinder is a rectangular parallelepiped shape, and the piston is a shape corresponding and applicable to the shape of the cylinder. Thus, a rectangular parallelepiped thin type pump can be provided.

BRIEF DESCRIPTION OF THE DRAWINGS

These and other objects will become more apparent when a preferred embodiment of this invention is considered in connection with the accompanying drawings, in which.

DETAILED DESCRIPTION OF THE INVENTION

Figure 1:
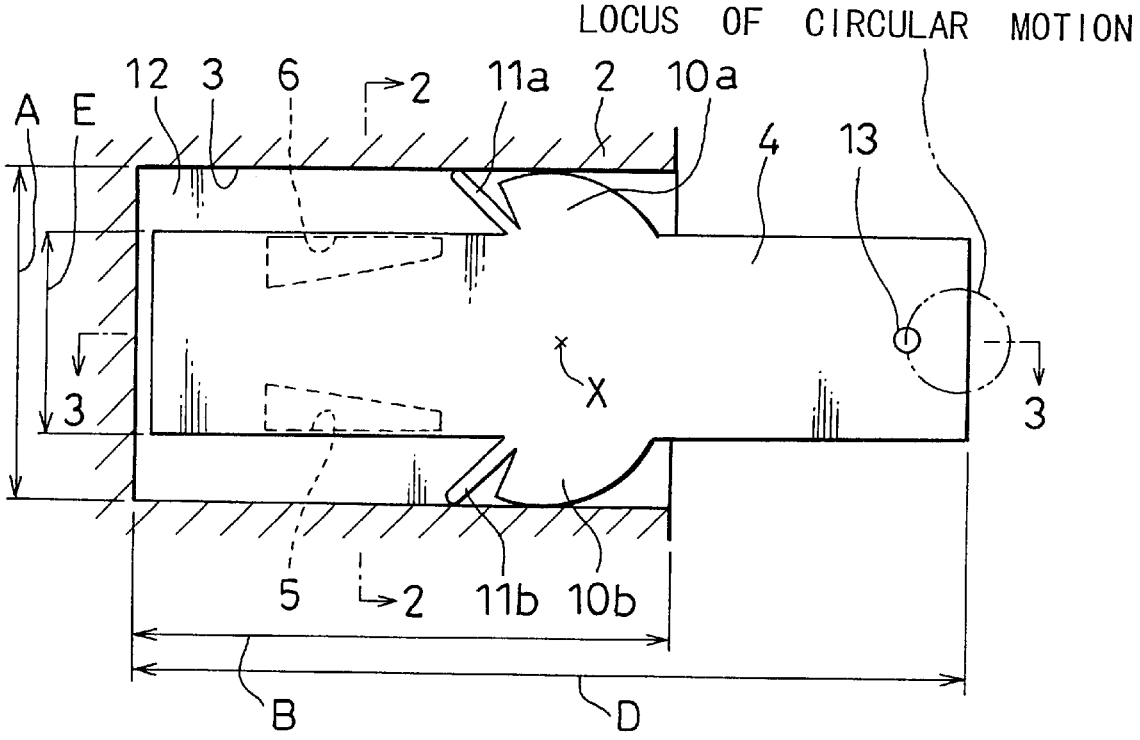
FIG. 1 is a cross section view illustrating a working mode of this invention.
Figure 2:
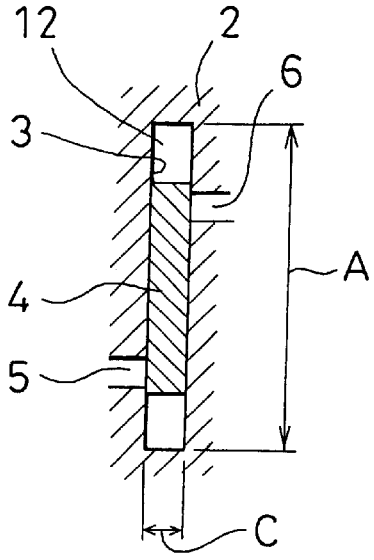
FIG. 2 is a cross section view taken on line 2—2 of FIG. 1.
Figure 3:
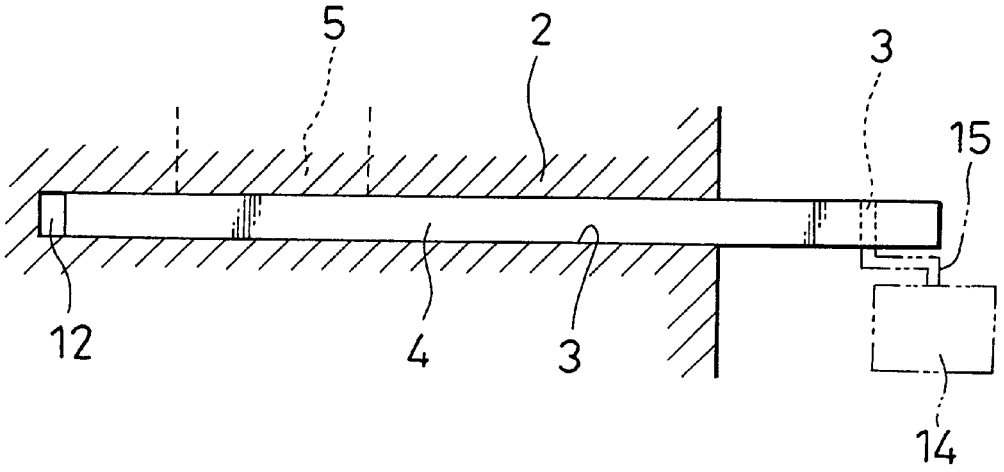
FIG. 3 is a cross section view taken on line 3—3 of FIG. 1.

Hereinafter, a working mode of this invention is explained by referring to the drawings.

In FIGS. 1 through 4, a pump comprises a body 2, a cylinder 3 formed in the body 2 and a piston 4 located in the cylinder 3. In this invention, the cylinder 3 is formed in a rectangular parallelepiped shape. In the cylinder 3, a long width A of an opening portion in which the piston 4 is inserted is a little less than about one-half of a depth B in the piston's inserting direction, and a short width C of the opening portion is approximately one-tenth of the long width A. The cylinder 3 is made of a material such as metal and resin, and an intake port 5 and an outlet port 6 are opened at specific positions of the cylinder 3, respectively.

The piston 4 is formed in a thin shape with a thickness similar to the short width C of the cylinder 3, and inserted into the cylinder 3 slidably. Besides, a length D (i.e. a second width D) of the piston 4 is longer than the depth B, and a length E in the width direction (i.e. a first width E) of the piston 4 is constituted shorter than the long width A of the cylinder 3. Note that the pump is usable in delivery of fluid on the order of 0.001 cc to 10 cc. It is only natural that the above mentioned size is changed by fluid's flowability, pressure, quantity and so on.

Besides, the piston 4 is provided with a pair of projecting portions 10*a*, 10*b*, each of which extends in a side direction at an approximate center of a side surface along a longitudinal direction thereof, projecting surfaces of which are formed in an arc shape. Also, front ends of the projecting portions 10*a*, 10*b* are in contact with inner surfaces of the cylinder 3, and the piston 4 oscillates by each of the projecting portions as a supporting point for oscillating motion. A center X of the oscillating motion is positioned at a center of a line connected between two contact points at which the projecting portions 10*a*, 10*b* are in contact with the inner surfaces of the cylinder 3.

Moreover, sealing portions 11*a*, 11*b* are formed adjacent to the projecting portions 10*a*, 10*b* in the piston 4. The sealing portions 11*a*, 11*b* extend from the side surfaces of the piston 4 to the inner surfaces of the cylinder 3, front ends of the sealing portions being in contact with the inner surfaces of the cylinder 3. As a result, a pump chamber 12 is defined by the sealing portions 11*a*, 11*b*, the piston 4 and the cylinder 3. In this embodiment, communication between the pump chamber 2 and the outside of the cylinder 3 is cut off by providing the sealing portions 11*a*, 11*b*, but these sealing portions 11*a*, 11*b* can be omitted when dimensional accuracy between the projecting portions 10*a*, 10*b* and the cylinder 3 is increased so as to increase sealing performance. Furthermore, a sealing material can be provided around the piston 4 instead of the sealing portions 11*a*, 11*b* to cut off leakage between the pump chamber 12 and the outside of the cylinder 3.

Furthermore, a hole 13 for driving is formed in an outer side end portion of the piston 4. One end of a crank shaft 15 of a driving source 14 for giving reciprocating and oscillating motion to the piston 4 is inserted into the hole 13 to transmit external driving power (circular motion) to the piston 4. Therefore, the hole 13 is a driving point of the piston 4. Besides, in this embodiment, the driving point 13 is moved in a circular motion by the driving source 14, but the driving point 13 may be moved in another circulating motion such as an elliptic motion or a square motion. Furthermore, the driving source 14 employed in this embodiment is a means for driving such as manual operation or a motor for rotating the crank shaft 15. The circular motion (a locus of the circular motion is shown in the figures) by the driving source 14 is transmitted to the piston 4, so that the piston 4 repeats the following reciprocating and oscillating motion.

Besides, the intake port 5 and the outlet port 6 are formed in the cylinder 3 so as to be closed when the piston 4 is positioned in parallel with the cylinder 3.

Hereinafter, operation of the pump is explained with reference to FIGS. 1, 4, 5 and 6. At first, as shown in FIG. 1, when the piston 4 s located at an upper dead point such that capacity of the pump chamber 12 is minimum and the piston 4 is in parallel with the cylinder 3, both of the intake port 5 and the outlet port 6 are closed. While the driving point 13 rotates through 90° from the position shown in FIG. 1 by the driving source 14, the piston 4 moves in the direction such that capacity of the pump 12 increases and oscillates by a contacting point of the projecting point 10*b* and the inner surface of the cylinder 3 as a supporting point. Thus, as shown in FIG. 4, since the intake port 5 is communicated with the pump chamber 12 and the capacity of the pump chamber 12 is increased, fluid is sucked into the pump chamber 12 via the intake port 5.

Figure 4:
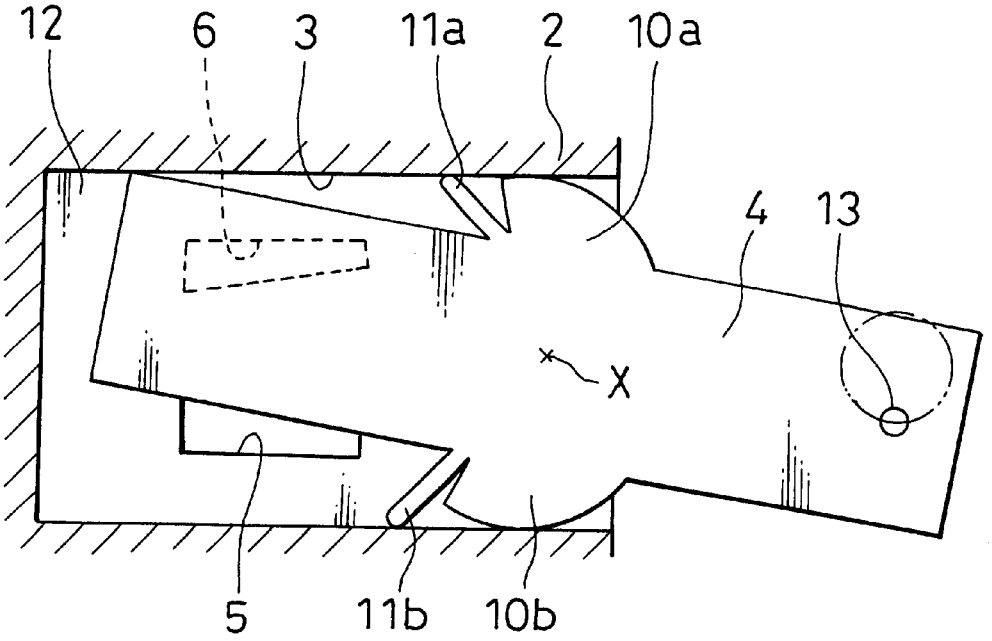
FIG. 4 is a cross section view showing the condition in which a driving point is rotated through 90° from the condition shown in FIG. 1.
Figure 5:
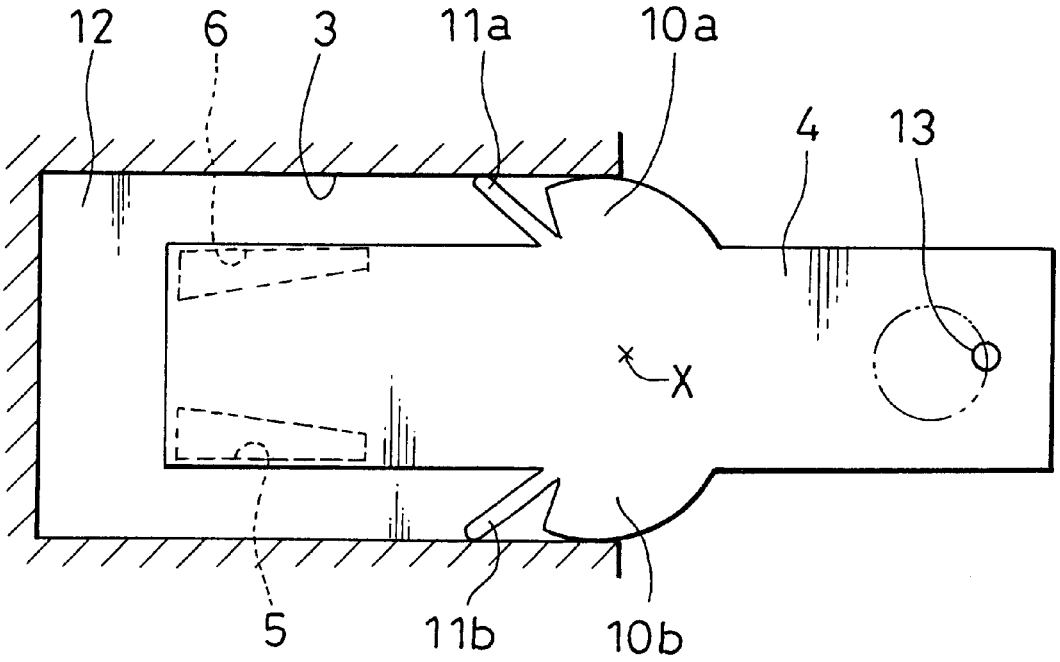
FIG. 5 is a cross section view showing the condition in which a driving point is rotated through 180° from the condition shown in FIG. 1.

While the driving point 13 is rotated through 90° from the position shown in FIG. 4 by the driving source 14, the piston 4 moves to a lower dead point such that the capacity of the pump chamber 12 becomes maximum and the piston 4 is located in parallel with the cylinder 3. At this time, the piston 4 oscillates in the direction such that the intake port is closed, and a suction process is terminated by closing the intake port 5. The process from the condition shown in FIG. 1 via the condition shown in FIG. 4 to the condition shown in FIG. 5 is called the suction process. During the suction process, the outlet port 6 is closed continuously.

Figure 6:
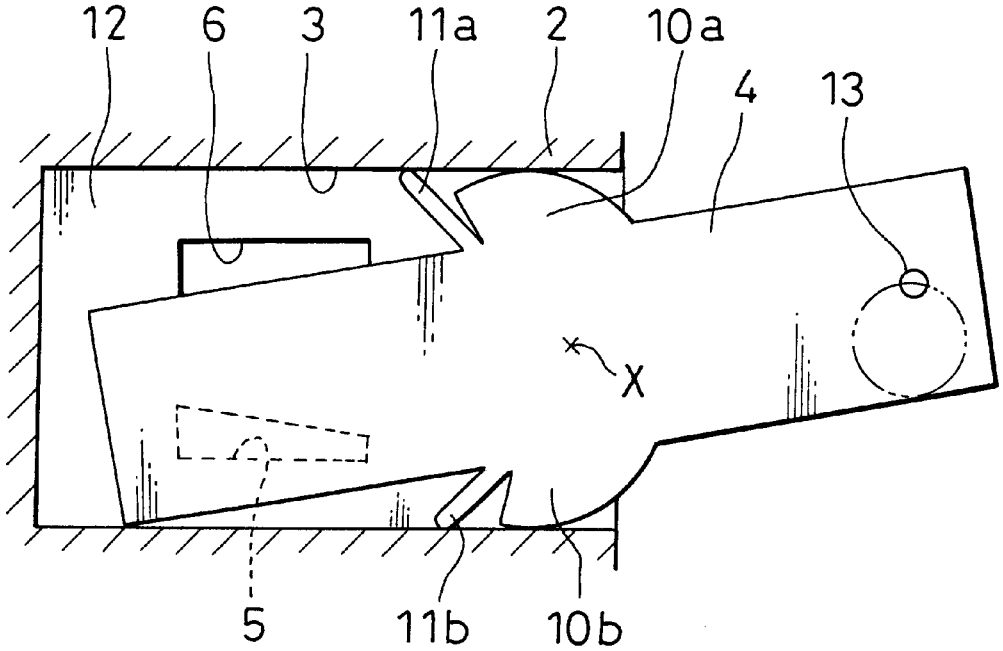
FIG. 6 is a cross section view showing the condition in which a driving point is rotated through 270° from the condition shown in FIG. 1.

Next, while the driving point 13 is rotated through 90° from the condition shown in FIG. 5 to the condition shown in FIG. 6 by the driving source 14, the piston 4 moves in the direction such that the capacity of the pump chamber 12 is decreased and oscillates about the contact point of the projecting portion 10*a* and the inner side surface of the cylinder 3 as a supporting point, and the outlet port 6 is opened to discharge the compressed fluid.

Then, while the driving point 13 rotates through 90° from the condition shown in FIG. 6, the piston 4 moves to the condition such that the capacity of the pump chamber 12 is decreased and becomes minimum as shown in FIG. 1, and the piston 4 oscillates in the direction such that the outlet port 6 is closed, so that the discharge process is terminated by closing the outlet port 6. Namely, the process from the condition shown in FIG. 5 via the condition shown in FIG. 6 to the condition shown in FIG. 1 is the discharge process. Thus, the driving point 13 is rotated continuously by the driving source 14, so that the above-mentioned operation is repeated to gain a pump function for sucking and discharging fluid.

Note that the rotation direction of the circular motion supplied from the outside is not defined especially. Besides, positions at which the intake port 5 and the outlet port 6 are formed are changed corresponding to motion of the piston 4. Furthermore, in the above-mentioned embodiment, the driving point 13 rotates counterclockwise and the locus of the driving point 13 is a circular trace, but it is contemplated that the rotational direction may be clockwise and the locus may be a loop such as an ellipse or a square.

Thus, in this invention, because the intake port 5 and the outlet port 6 are opened and closed forcibly by the oscillating function of the piston 4, it is not necessary to provide check-valves on the intake port 5 and the outlet port 6.

Furthermore, in the embodiment, the oscillating motion of the piston 4 is operated by the pair of the projecting portions formed on the piston 4 as the supporting points, but the invention is not to this constitution limited, and can be achieved by fixing the oscillating center X movably in the reciprocating direction of the piston 4. Concretely, it can be achieved that axes are provided on the oscillating center X, sliding grooves are formed along the reciprocating direction of the cylinder 3 and the axes are inserted into the sliding grooves slidably.

As the above-mentioned, according to this invention, reciprocating and oscillating motion of the piston can make the capacity of the pump chamber increase and decrease and the intake port and the outlet port open and close alternately to suck, compress and discharge fluid, so that there is an advantage such that it is not necessary to provide check-valves in the intake port and the outlet port, and further, it can contribute to decreasing the number of the parts. Besides, miniaturization can be promoted by decreasing the number of the parts and providing a thin type pump with a square shape (a shape like a plate).

Having described our invention as related to the embodiment shown in the accompanying drawings, it is our intention that the invention be not limited by any of the details of the description, unless otherwise specified, but rather be constructed broadly within its spirit and scope as set out in the accompanying claims.

What is claimed is:

1. A pump comprising:

an approximately rectangular parallelepiped cylinder with a long width, a short width and a depth;

an intake port and an outlet port opening on said cylinder;

a piston inserted into said cylinder via said opening portion with a thickness similar to said short width of said cylinder, a first width shorter than said long width of said cylinder, a second width longer than said depth of said cylinder;

a pair of projecting portions extending outward from approximately centers of surfaces along said second width and having arc surfaces coming in contact with inner surfaces of said cylinder, respectively;

a pump chamber defined by said cylinder and said piston; and a driving means for causing reciprocating motion and oscillating motion of said piston relative to said cylinder;

wherein said intake port and said outlet port are closed by said piston when said piston is located at an upper dead point and a lower dead point; and wherein said driving means causes said reciprocating motion of said piston relative to said cylinder to vary capacity of said pump chamber and causes said oscillating motion of said piston relative to said cylinder to open said intake port and said outlet port alternately.

2. A pump according to claim 1, wherein:

contacting points on which said pair of said projecting portions contact said inner surfaces of said cylinder are supporting points for said oscillating motion of said piston.

3. A pump according to claim 1, wherein:

sealing portions are formed adjacent to said pair of said projecting portions to cut off between said pump chamber and an outside of said cylinder.

4. A pump according to claim 2, wherein:

sealing portions are formed adjacent to said pair of said projecting portions to cut off between said pump chamber and an outside of said cylinder.

5. A pump according to claim 3, wherein:

said sealing portions are formed with said piston unitedly.

6. A pump according to claim 4, wherein:

said sealing portions are formed with said piston unitedly.

7. A pump according to claim 1, wherein:

said long width of said cylinder is less than one-half of said depth of said cylinder.

8. A pump according to claim 2, wherein:

said long width of said cylinder is less than one-half of said depth of said cylinder.

9. A pump according to claim 3, wherein:

said long width of said cylinder is less than one-half of said depth of said cylinder.

10. A pump according to claim 4, wherein:

said long width of said cylinder is less than one-half of said depth of said cylinder.

11. A pump according to claim 5, wherein:

said long width of said cylinder is less than one-half of said depth of said cylinder.

12. A pump according to claim 6, wherein:

said long width of said cylinder is less than one-half of said depth of said cylinder.

13. A pump according to claim 7, wherein:

said short width of said cylinder is approximately one-tenth of said long width of said cylinder.

14. A pump according to claim 8, wherein:

said short width of said cylinder is approximately one-tenth of said long width of said cylinder.

15. A pump according to claim 9, wherein:

said short width of said cylinder is approximately one-tenth of said long width of said cylinder.

16. A pump according to claim 10, wherein:

said short width of said cylinder is approximately one-tenth of said long width of said cylinder.

17. A pump according to claim 11, wherein:

said short width of said cylinder is approximately one-tenth of said long width of said cylinder.

18. A pump according to claim 12, wherein:

said short width of said cylinder is approximately one-tenth of said long width of said cylinder.

* * * * *